United States Patent [19]

Seman

[11] 4,379,187

[45] Apr. 5, 1983

[54] METHOD OF PRODUCING A BRICK WALL FACING

[76] Inventor: David C. Seman, 640 Brown Ave., Erie, Pa. 16502

[21] Appl. No.: 528,674

[22] Filed: Dec. 2, 1974

[51] Int. Cl.[3] ..... B05D 1/32

[52] U.S. Cl. ..... 427/282; 33/174 B; 156/247; 156/280; 427/143; 427/272; 428/53; 428/343

[58] Field of Search ..... 427/282, 143, 272, 258; 156/247, 280; 33/174 B

[56] References Cited

U.S. PATENT DOCUMENTS

| | | | |
|---|---|---|---|
| 278,238 | 5/1883 | Harding | 427/282 |
| 333,459 | 12/1885 | Gibson | 427/282 |
| 2,056,274 | 10/1936 | Holdsworth | 427/282 |
| 2,365,705 | 12/1944 | Jeri | 427/282 |
| 3,096,195 | 7/1963 | Seman et al. | 427/272 |

FOREIGN PATENT DOCUMENTS

| | | | |
|---|---|---|---|
| 348230 | 5/1931 | United Kingdom | 427/282 |
| 896135 | 5/1962 | United Kingdom | 427/282 |

*Primary Examiner*—John D. Smith
*Assistant Examiner*—Janyce A. Bell
*Attorney, Agent, or Firm*—Ralph Hammar

[57] ABSTRACT

The method of U.S. Pat. No. 3,096,195, incorporated by reference, is simplified by applying adhesive tape units, each of which consists of an assembly of a horizontal adhesive tape representing a horizontal mortar line for a course of brick to which are fixed vertical tapes spaced to represent vertical mortar lines between adjacent bricks. Apparatus is provided for making the tape units.

23 Claims, 4 Drawing Figures

METHOD OF PRODUCING A BRICK WALL FACING

This invention is an improvement on the method of applying a simulated brick facing to a building wall which consists first of applying to the building wall a pattern of adhesive tape corresponding to the mortar lines, second plastering a skim coating of cement over the tape and wall and third pulling the tape off the wall to remove the cement coating overlaying the tape and thereby provide mortar lines. This invention is intended to simplify the process of applying the pattern of adhesive tape and thereby reduce the overall cost of the facing.

Figure 2:
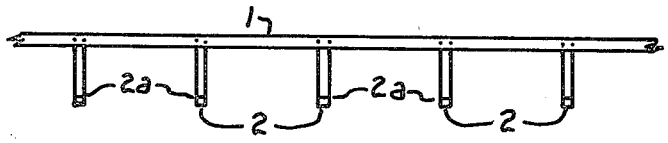
Figure 1:
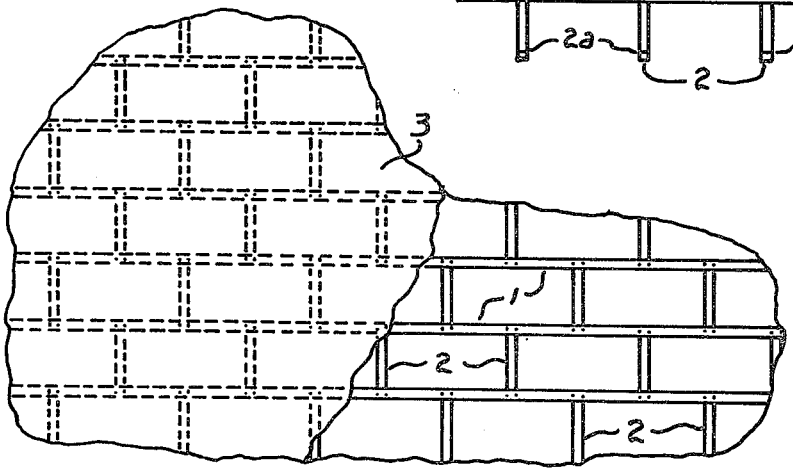
Figure 3:
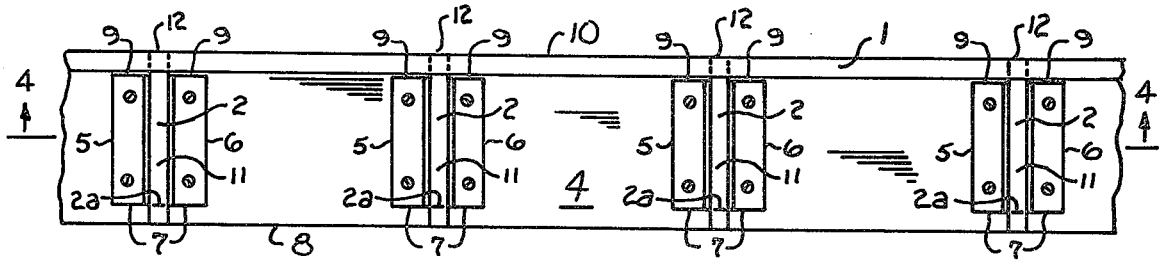
Figure 4:
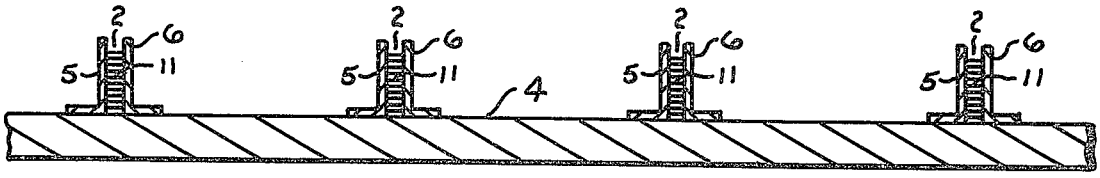

In the drawing, FIG. 1 shows a section of a building wall to which a simulated brick facing is to be applied, FIG. 2 is an elevation of a tape unit for providing the mortar lines in the simulated brick facing, FIG. 3 is a plan view of a machine or apparatus for making the tape assemblies of FIG. 2 and FIG. 4 is a section on line 4—4 of FIG. 3.

In applying the simulated brick facing as diagrammatically shown in FIG. 1, the wall to be faced may be first plastered by spraying, trowelling or other suitable procedure with a ground or prime coat of suitable cement of color corresponding to mortar lines. This is a matter of surface preparation which provides an adherent coating and smooths out any irregularities. The next step is to apply adhesive tape units or assemblies to the ground coat in the areas in which mortar lines are to be present in the finished coating. Each of these tape units or assemblies as shown in FIG. 2 comprises a continuous horizontal tape 1 of length and width corresponding to the horizontal mortar line of a course of a plurality of bricks from which depend vertical tape sections 2 of length and width corresponding to vertical mortar lines between the bricks in the course. The vertical tape 2 may be plain uncoated paper. The horizontal tape 1 may be paper coated on its under side with a pressure sensitive adhesive which allows the tape to be stripped off the surface to which it is adhered. The horizontal tape overlies and adheres to the upper ends of the vertical tapes. The space between adjacent vertical sections 2 corresponds to the length of an individual brick. In a preferred method of application the tape assemblies are successively applied as a unit from top to bottom of the wall to be covered. Each tape assembly is applied as a unit. The horizontal tape of first tape assembly is lined up so that it is horizontal and is positioned to correspond with the horizontal upper mortar line of the top course of brick, and the vertical tapes depend from the horizontal tape to represent the vertical mortar line of the top course of brick. The next tape assembly is applied with its horizontal and vertical tapes 1, 2, positioned to represent the top and vertical mortar lines of the next lower course of brick and with its vertical tapes properly staggered with reference to the previously applied assembly. The length of the vertical strips 2 is preferably equal to the length of a vertical mortar line plus twice the thickness of a horizontal mortar line so that when applied, the horizontal tapes overly and adhere to the upper and lower ends of the vertical tapes. In order to assist in proper alignment of the horizontal tapes, the vertical tapes may have guide lines 2*a* positioned the thickness of a horizontal mortar line from the upper and lower ends. The length of the vertical strips 2 automatically provides the proper spacing between horizontal strips 1 so that only at the start and at infrequent intervals thereafter is it necessary to check the level of the horizontal strips. After the strips are applied, a finish or skin coat 3 is plastered over the entire wall surface. The color of the coat 3 is that of the finished brick. The coat may be of one or more layers and may be suitably textured. After the finish coat 3 is applied and textured, the assemblies 1, 2 are pulled off individually or several at a time, removing the overlying portion of the finish coat 3 and exposing the underlying ground coat to provide a simulated mortar line. The ground and finish coats may be of any suitable plaster material having the desired appearance and properties. Such materials are available in a wide variety of colors.

The vertical tapes are preferably plain paper. This simplifies the handling. The finish coat has no tendency to run under the tapes. The horizontal tapes hold the vertical tapes in position. The plastering forces whether by spray or trowel push the tapes against the wall. The tapes are removed while the plaster finish coat is wet so the tapes merely lift off the plaster which is directly on the tapes.

FIGS. 3 and 4 show an apparatus for producing the tape units or assemblies 1, 2. The apparatus has a support 4 of width equal to the thickness of a brick plus the width of two horizontal mortar lines and of length equal to a conveniently handled length horizontal tape 1. A plurality of sets of stacking guides 5, 6 are fastened to the support with lower ends 7 and upper ends 9 respectively spaced from the lower edge 8 and the upper edge 10 of the support a distance equal to the width of a horizontal mortar line. The spacing between guides 5, 6 is equal to the width of a vertical mortar line, and the spacing between adjacent sets of guides is equal to the length of a brick.

In use, a stack 11 of vertical tapes 2 is placed in each guide with the upper edge 12 of the stack flush with the edge 10 of the support. A length of horizontal tape 1 is stretched above the upper ends of the tape with the pressure sensitive adhesive down, and aligned with the edge 10 of the support and with the upper ends 9 of the guides and then lowered into pressure contact with the upper ends of the stack of vertical tapes. When the horizontal tape is lifted, the uppermost of the vertical tapes in each stack will be attached to the horizontal tape as shown in FIG. 2.

In the installation of the units made of assemblies of horizontal and vertical tapes, the horizontal tape of each section is positioned on the wall to correspond with a horizontal mortar line and with the vertical tapes staggered so as to correspond with vertical mortar lines on a brick wall. In the prior art method, horizontal tapes were installed on the wall vertically spaced from each other to provide the horizontal mortar lines. Separate vertical tapes were then placed to bridge the spaces between the horizontal tapes to provide the vertical mortar lines. The placing of the vertical tapes was a time consuming job, usually requiring at least half the time required for the entire installation from the bare wall to the finished facing. In the present method, the installation of the units requires no more time than the installation of the horizontal tapes in the prior art method. This reduces by at least one half the overall time required for installation of the facing.

The assemblies can be handled in the same manner as strips of single faced pressure sensitive adjesive tape. On flat wall surfaces, the assemblies are applied in straight lengths joined end to end if necessary for long walls. At corners and window openings, the assemblies bend around the corners to provide the appearance of corner bricks.

Pressure sensitive adhesive tape is tacky and sticks readily to any wall surface (or other tape) with which it is brought in contact. If the tape initially sticks in an unwanted position, it must be lifted off before it can be shifted to the desired position. While the tape can easily be strung in long lengths, either horizontal or vertical, handling a multiplicity of short lengths as required by patent 3,096,195 is tedious and time consuming.

The terms horizontal and vertical are used to define the relative positions of the strips of tape and not by way of limitation.

The need for a brick rule is eliminated. Level installation of the first tape 1 is all that is required. The guide lines *2a* serve as a rule and indicate the level position for succeeding tapes 1.

What is claimed is:

1. A unit for simulating mortar lines of a brick wall comprising a horizontal pressure sensitive adhesive tape of width and length corresponding to a horizontal mortar line of a course of a plurality of bricks, and a plurality of vertical tapes of length and width corresponding to vertical mortar lines between bricks in said course, the vertical tapes being adhered at one end to said horizontal tape on spacing corresponding to the spacing of the bricks in said course, and said unit being preassembled and capable of installation as a unit on a surface on which said mortar lines are to be simulated.

2. The unit of claim 1 in which the vertical tapes are paper.

3. The unit of claim 1 in which the length of the vertical tapes is equal to the width of a brick in said course plus the thickness of between one and two horizontal mortar joints in said course.

4. The unit of claim 1 in which the vertical tapes are long enough so that when two units are installed one above the other on a wall the other ends of the vertical tapes of the upper unit register with the horizontal tape of the lower unit.

5. The unit of claim 4 in which said vertical tapes of the upper unit have guide lines on the other ends for indicating the position in which the horizontal tape of the lower unit is to be installed.

6. The method of making the unit of claim 1 which comprises positioning the vertical and horizontal tapes in the relative positions required for said unit with the adhesive of the horizontal tape aligned with and presented to one end of the vertical tapes, and pressing the horizontal tape and said one end of the vertical tapes together to assemble the unit.

7. The method of claim 6 in which the vertical tapes are paper.

8. The method of claim 7 in which the vertical tapes are arranged in stacks corresponding to the vertical mortar joints of a course of brick and said horizontal tape is adhered to and lifts the uppermost vertical tapes off the stacks.

9. Starting with the unit of claim 1, the method of applying a simulated brick facing to a wall which comprises (1) applying to said wall a plurality of said units, said units being applied to the wall with horizontal tapes spaced to correspond to the horizontal mortar lines of a brick wall and with the vertical tapes of adjacent units in staggered relation to each other in the manner of vertical mortar lines in a brick wall, (2) Plastering a skim coat of cement over said wall and tapes, and (3) pulling off the tapes substantially immediately to remove the cement overlying the tapes and expose the mortar lines while leaving the balance of the skim coat adhered to the wall.

10. The method of claim 9 using the units of claim 2.

11. The method of claim 9 using the units of claim 2.

12. The method of claim 9 using the units of claim 3.

13. The method of claim 9 using the units of claim 5.

14. Starting with the unit of claim 1, the method of applying a simulated brick facing to a wall which comprises (1) applying a first unit to the top of the wall with the first pressure sensitive tape horizontal and the vertical tapes depending, applying a second unit with the pressure sensitive tape horizontal and overlapping the lower ends of the vertical tapes of the preceeding unit and with its vertical tapes depending and in staggered relation to the vertical tapes of the preceeding unit in the manner of the vertical mortar lines in a brick wall, applying succeeding units by the steps of the second unit.

(2) Plastering a skim coat of cement over said wall and tapes, and (3) pulling off the tapes substantially immediately to remove the wet cement overlying the tapes and to expose the mortar lines and leaving the balance of the skim coat adhered to the wall.

15. The method of claim 14 using the units of claim 2.

16. The method of claim 14 using the units of claim 3.

17. The method of claim 14 using the units of claim 4.

18. The method of claim 14 using the units of claim 5.

19. A unit for simulating on a building wall the horizontal and vertical mortar lines of a brick wall, comprising horizontal and vertical tapes intersecting at right angles and of width corresponding to said horizontal and vertical mortar lines, at least one of said tapes having guide lines for indicating the position in which another of said tapes is to intersect said one of said tapes, and at least one of said tapes being pressure sensitive adhesive tape which adheres to the other of said tapes and to said building wall.

20. The unit of claim 1 in which the vertical tapes consist essentially of paper.

21. The unit of claim 20 in which the vertical tapes are long enough so that when two units are installed one above the other on a wall the other ends of the vertical tapes of the upper unit register with the horizontal tape of the lower unit.

22. The unit of claim 21 in which said vertical tapes of the upper unit have guide lines on the other ends for indicating the position in which the horizontal tape of the lower unit is to be installed.

23. The unit of claim 21 in which the other ends of the vertical tapes underlie the horizontal tape of the lower unit.

* * * * *